United States Patent [19]

Mukumoto et al.

[11] Patent Number: 4,993,924

[45] Date of Patent: Feb. 19, 1991

[54] RECIPROCATING PUMP

[75] Inventors: Eiichi Mukumoto, Takarazuka; Mitsufumi Kishimoto, Kobe, both of Japan

[73] Assignee: Konan Electric Co., Ltd., Nishinomiya, Japan

[21] Appl. No.: 335,913

[22] Filed: Apr. 10, 1989

[30] Foreign Application Priority Data

Apr. 15, 1988 [JP] Japan ..... 63-91778

[51] Int. Cl.[5] ..... F04B 17/00

[52] U.S. Cl. ..... 417/402; 137/512.3

[58] Field of Search ..... 277/152, 153, 134, 189, 277/165; 137/102, 512.3; 417/398-403

[56] References Cited

U.S. PATENT DOCUMENTS

| | | | |
|---|---|---|---|
| 3,814,548 | 6/1974 | Rupp | 417/395 |
| 4,303,250 | 12/1981 | Persson | 277/189 |
| 4,828,272 | 5/1989 | Pederson | 277/165 |

FOREIGN PATENT DOCUMENTS

| | | | |
|---|---|---|---|
| 1003674 | 3/1957 | Fed. Rep. of Germany | 277/189 |
| 2168028 | 8/1975 | U.S.S.R. | 417/403 |

*Primary Examiner*—Michael Koczo
*Assistant Examiner*—John A. Savio, III
*Attorney, Agent, or Firm*—Jordan and Hamburg

[57] ABSTRACT

In the preferred and illustrated embodiment of a reciprocating pump, a plunger for pumping a liquied, a piston for reciprocating the plunger and a selector valve for changing a pilot flow passage between a supply passage communicating a pressure chamber with a supply port and a discharge passage communicating the pressure chamber with a discharge port are disclosed. The selector valve is switched by a pilot valve means. A pilot valve body of the pilot valve means is so designed to engage with the piston for predetermined distances to and from the ends of the respective forward and backward strokes of the piston and to be moved to the switching position where the pilot valve body opens one of the pilot supply passage working against the selector valve and the pilot discharge passage and close the other of the pilot passages and the pilot valve body is released from engagement with the piston and held at the switching position for a predetermined distance after the stroke of the piston is reversed.

3 Claims, 5 Drawing Sheets

RECIPROCATING PUMP

FIELD OF THE INVENTION AND RELATED ART STATEMENT

The present invention relates to a reciprocating pump apparatus in which a piston is reciprocated by switching supply and discharge of the pressurized fluid and the liquid is sucked through a suction valve and delivered through a delivery valve by reciprocation of the plunger coupled with the piston.

An example of the reciprocating pump apparatuses of this type according to a prior art is known for example from the Japanese Patent Publication No. 48-29882 wherein supply and discharge of the pressurized fluid such as compressed air into a cylinder containing a piston is switched by a directional control valve and when the pressure fluid is being supplied the piston is caused to move forward by against the biasing force of a restoring spring and when the pressure fluid is being discharged, the piston is caused to return under the influence of the restoring spring and switching operation of the change-over valve takes place by switching the pilot flow passages working against the change-over valve by means of a pilot valve which is activated by the piston at the reversal position of reciprocation of the piston.

According to the pump apparatus of the above-mentioned type of a prior art, the piston is caused to reciprocate due to the difference between the thrust force acting to the piston at the side of the pressurized fluid working against the piston and the thrust force acting to the piston at the load side, so that the plunger moved by the piston is caused to act as a reciprocating pump for suctioning and delivering the fluid.

When the thrust force acting to the piston at the load side becomes so large as to be balanced with the thrust force at the pressurized fluid side, then the piston and the plunger are caused to stop, so that the pumping action of the plunger will also be stopped. When the thrust force at the load side becomes decreased or the thrust force at the pressurized fluid side becomes increased resulting in unbalance between both thrust forces, then the piston is caused to reciprocate to cause the plunger to pump the fluid or to suck and deliver the fluid.

When the pump apparatus starts operation, the suction conduit connected to the suction inlet of the pump apparatus may be filled with pressurized fluid such as compressed air or the like or incompressive fluid such as oil in which compressive fluid is mixed may be contained in such conduit. Such incompressive fluid as oil or the like may be delivered by sucking the fluid contained in the suction conduit through the suction valve by reciprocation of the plunger and deliver it through the delivery valve, and making the pressure in the suction conduit to a negative pressure lower than the atomospheric pressure. When the compressive fluid or the incompressive fluid including compressive fluid is contained in the conduit, the load resistance imposed against the plunger is smaller than in the case of incompressive fluid only being contained. When the load resistance is small, the piston is caused to reciprocate at higher frequency, so that in case of the compressive air only being contained, the so-called idle hammering condition will be resulted.

When the plunger is caused to act as the pump by the reciprocation of the piston, it is inevitable to avoid generation of the fluid film of the fluid sucked or delivered on the outer surface of the plunger which is reciprocating. Although a fluid sealing means is provided at the plunger, yet it is impossibel to completely avoid escape of the fluid. Therefore, such a method is sometimes employed as to provide a drain port to enable the drained fluid to be returned to a tank.

OBJECT AND SUMMARY OF THE INVENTION

According to the prior art pump apparatus as above explained when the thrust force at the side of the pressure fluid for a piston and tank at the load side is, nearly balanced, the piston will be caused to move at an extremely slow speed almost like stoppage. And when such a piston as moving at an extremely slow speed comes to the reversal position of reciprocation, the piston after having activated the pilot valve at said reversal position will turn back, so that the pilot valve will come back to an inoperable condition after its activation for short period of time. Therefore it will cause the change-over valve either to stop at an intermediate position or to move it at an extremely slow speed, resulting in such a problem as the pressure at the load side can not be increased by quick reciporcation of a piston. Paticularly when the piston which is caused to move at an extremely slow speed comes near to the reversal position from the forward movement to the backward movement, the piston will activate the pilot valve for discharge and will turn back soon, so that the piston valve will be released after a short period of time. The pressure of the pressure fluid working against to change-over valve will be decreased while the pilot valve for fluid supply is closed. However the pilot valve for fluid discharge will be closed although said pressure has not been decreased to a level required for operating the change-over valve for complete switching, so that the pressures actuating the change-over valve will be balanced and the switch-over movement of the change-over valve is stopped with the fluid drain passage of the pressure chamber for the piston being slightly opened and the piston is forced to return backwardly at an extremely slow speed. There is such a problem that under this condition, the piston cannot be quickly operated even when the pressure at the load side may be reduced abnormally. Furthermore, according to the pump apparatuses of prior arts, since the pressurized fluid will be supplied through the pilot valve for fluid supply pressure of the fluid will be gradually increased at the start-up of operation, the change-over valve will commence switching operation with a slow speed when the minimum pressure required for activation is reached. The pressurized fluid will be supplied to the pressure chamber for a piston through the pressurized fluid passage which has been slightly opened by operation of the change-over valve and the pilot valve for fluid discharge will be closed when the piston has slightly moved. Under this condition, since the pilot valve for discharge is closed, the passage for supply and discharge of the pressurized fluid also serving as the pilot fluid to work against the change-over valve is isolated whereby the change-over valve is caused to stop with the pressurized fluid supply passage to the pressure chamber for the piston being slightly opend. In this case, the piston will not be operated even if the pressurized fluid has reached a specified pressure or the piston will be allowed to operate normally after the piston which is moving at an extremely slow speed has activated the pilot valve for discharge at the reversal position for returning backwardly, or this means that start-up of operation cannot be executed efficiently.

The second problem with prior arts is that when the compressive fluid such as air or the like or the incompressive fluid including compressive fluid is filled in the suction conduit when the pump apparatus is to be started, then the load resistance is small, and the piston is caused to reciprocate at a higher frequency, so that the so-called idle hammering effect will be resulted to adversely effect the durability of various components due to precussion and so forth.

The third problem with prior art pump apparatuses is that when the pump is to be started up, the compressive fluid is discharged from the suction pipe to generate vacuum and deliver the incompressive fluid out. However, the cracking pressure at the suction valve has to be kept low in order to comply with a longer head at the suction conduit. However when the cracking pressure at the suction valve is kept low, the efficiency of the suction valve will be degraded.

The fourth problem with prior art pump apparatus is that since the pump chamber or the plunger chamber into which the fluid is directed by means of the plunger is connected to the delivery passage by the flow passage which is opened at the location intermediate of the plunger stroke, the fluid is forced to the delivery passage through the clearance around the plunger at the end of delivery stroke of the plunger. The construction having such a clearance volume is problem. More specifically, it is preferable to eliminate such a clearance volume at the start-up of operation so as to increase the vacuum in the suction conduit. However, a certain flow passage around a plunger is necessary to deliver the fluid at the delivery stroke of the plunger. When the flow passage is reduced to make the clearance volume smaller in view of increasing vacuum, then the pressure resistance for the fluid will be increased, so that the plunger will be reciprocated less frequently and the fluid delivery quantity will be reduced.

The fifth problem with prior arts is that the dust, foreign matters or the like which may be present in the suction conduit will be sucked by the pump apparatus together with the fluid in the conduit at the start-up of operation and the suction valve, the delivery valve and the plunger may be thereby damaged.

The sixth problem with the prior arts is that since the fluid sealing means adapted to prevent the fluid delivered by the plunger from flowing to the side of a piston is attached to the casing, when a high pressure fluid works against the plunger then the fluid sealing means may get jammed to the plunger, preventing smooth movement of the plunger and increased sliding resistance will further shorten the serviceable life of the plunger. When the contact pressure of the fluid sealing means relative to the plunger is reduced in an effort to avoid the problem as above mentioned, it cannot be avoided that the fluid film produced along the plunger is drawn to the side of the piston. If drain ports are provided to collect the fluid film thus drawn and return it to a tank, the provision of these means will cause added complicated operation.

The present invention has solved the above-mentioned problems by providing such a reciprocating pump apparatus wherein a pilot valve body is caused to engage with a piston for a specified distance to and from the end of the forward and backward reciprocation of the piston and move to a switching position where one of the pilot supply passage and the pilot discharge passage is opened and the other is closed, and for a specified distance after the piston has been reversed, engagement of the pilot valve body with the piston is released so that the pilot valve body is held at said switching position.

According to the present invention, the pilot valve body is allowed to move to the reversal position relaidless of the pilot speed, and at said reversal position one of the pilot fluid supply passage and the pilot fluid discharge passage is opened and the other is closed. And after the piston has been reversed in respect of reciprocation, the pilot valve body is held at the switching position while the piston alone is allowed to continue movement. In this way, the change-over valve may be completely switched from the position where one of the pressure fluid supply passage to and the pressure fluid discharge passage from the pressure chamber for the piston is fully opened and the other is fully closed to the position where the situation vice versa takes place.

The present invention has solved the second problem by supplying and discharging of the compressive fluid to the spring chamber for the piston through a variable throttle.

More specifically, the present invention has enabled the piston to reciprocate at a constant frequency regardless of the properties of the fluid, by providing a back pressure in the spring chamber by variably throttling the flow of the compressive fluid such as air or the like when said compressive fluid is sucked or delivered at such times as start-up to restrict reciprocation of the piston from being executed at a higher frequency and opening said throttling when the incompressive fluid alone is sucked or delivered so that any back pressure will be developed in the spring chamber.

Futhermore, the present invention has solved the third problem as above mentioned in such a manner that a weak spring is employed as the spring biasing the suction valve member of the suction valve against the valve seat so as to reduce the cracking pressure, and a throttle port for communicating the plunger chamber with the delivery passage is provided at the suction valve member.

Since a throttle port is provided, when movement of the plunger is switched from that of suction to that of delivery and the fluid is caused to flow from the plunger chamber to the delivery passage. At that time the fluid is imposed by resistance to generate pressing force by the plunger in the plunger chamber, whereby the suction valve member is urged not only by the spring but also by said pressing force by the plunger to be quickly seated in the valve seat, reducing the amount of the fluid which may be returned to the suction passage either from the plunger chamber or the pump chamber and avoiding reduction of the delivery efficiency.

The present invention has solved the fourth problem by providing an inlet to the delivery valve which is open to the pump chamber at the location adjacent to the plunger chamber at the end of the delivery stroke of the plunger.

At the time of delivery stroke movement of the plunger, the fluid in the plunger chamber is allowed to be discharged to the delivery passage directly through the inlet of the delivery valve as the shortest route and since it is not necessary for the fluid to go through the fine clearance around the plunger, the degree of vacuum in the suction conduit at the time of start-up may be increased and the pressure resistance caused by said clearance may be substantially eliminated, whereby reciprocation frequency of the plunger will not be reduced and reduction of delivery of the fluid may be avoided.

The fifth problem has been solved by the present invention by providing a filter at the inlet to the suction passage.

Since foreign matters and the like which come from the suction conduit are eliminated by said filter before the fluid reaches the suction valve, damage to the components of the pump apparatus may be prevented.

Furthermore, the present invention has solved the . sixth problem as above pointed out by constituting the fluid sealing means including the elastic ring and the seal ring having the sectional configuration of "L" adapted to receive the elastic ring, constituting the seal ring by use of a low abrasion, low sliding resistance material and forming a lip portion adapted to abut against the plunger at either the elastic ring or the seal ring.

Since the seal ring to which the plunger comes in direct contact is formed by a material of low abrasion, and low sliding resistance, the seal ring has been prevented from getting jammed to the plunger under a high pressure.

Between the plunger and the fluid sealing member, the seal ring is in sliding contact and the lip portion is in contact, whereby the fluid film developed by the plunger is prevented from being drawn out.

The present invention will now be described in more detail by referring to the accompanying drawings wherein.

DESCRIPTION OF THE PREFERRED EMBODIMENTS

Figure 1:
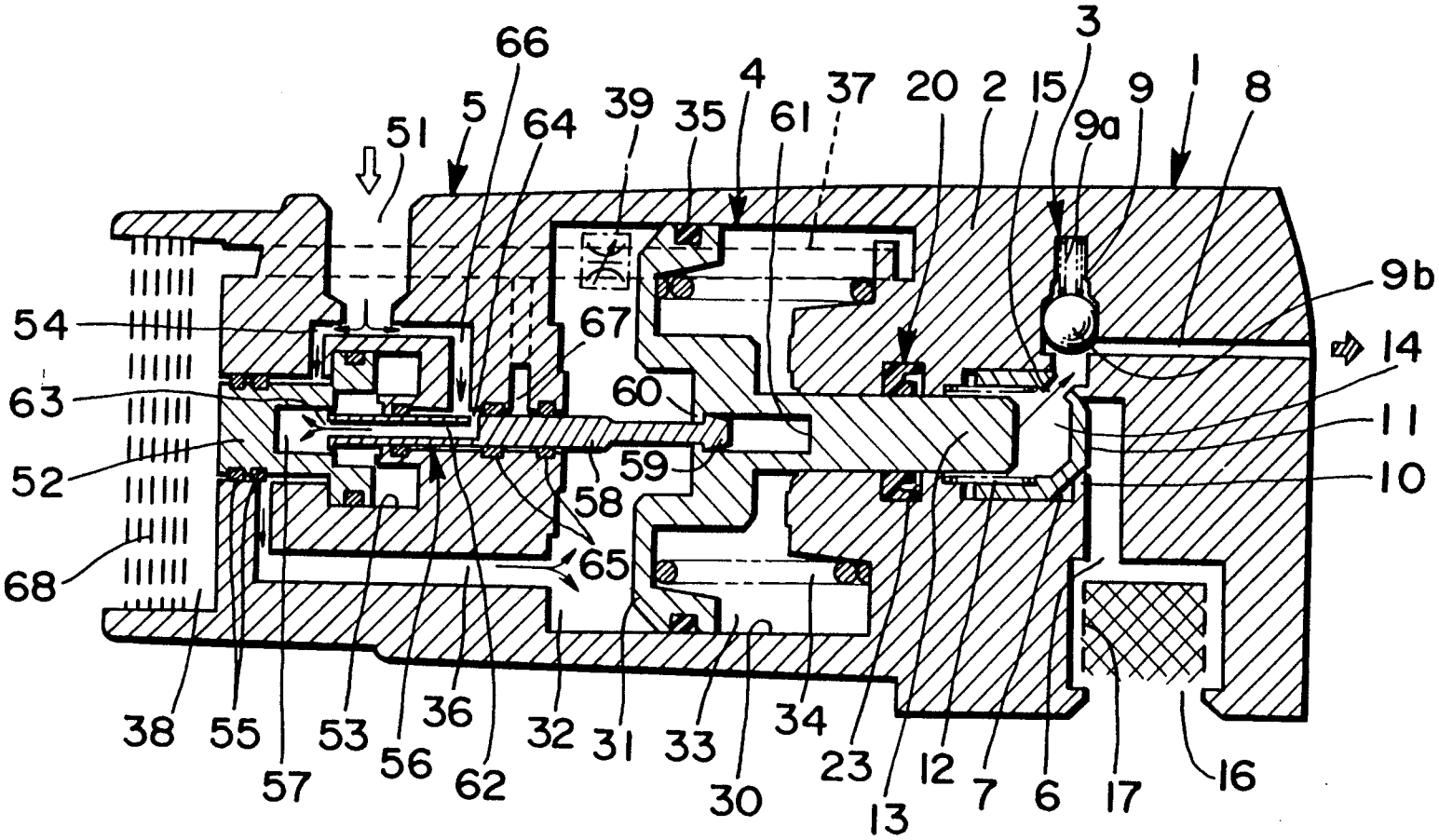
FIG. 1–FIG. 3 illustrate the sectional views of the reciprcating pump apparatus according to the present invention in each one step of movement of the respective components.
Figure 2:
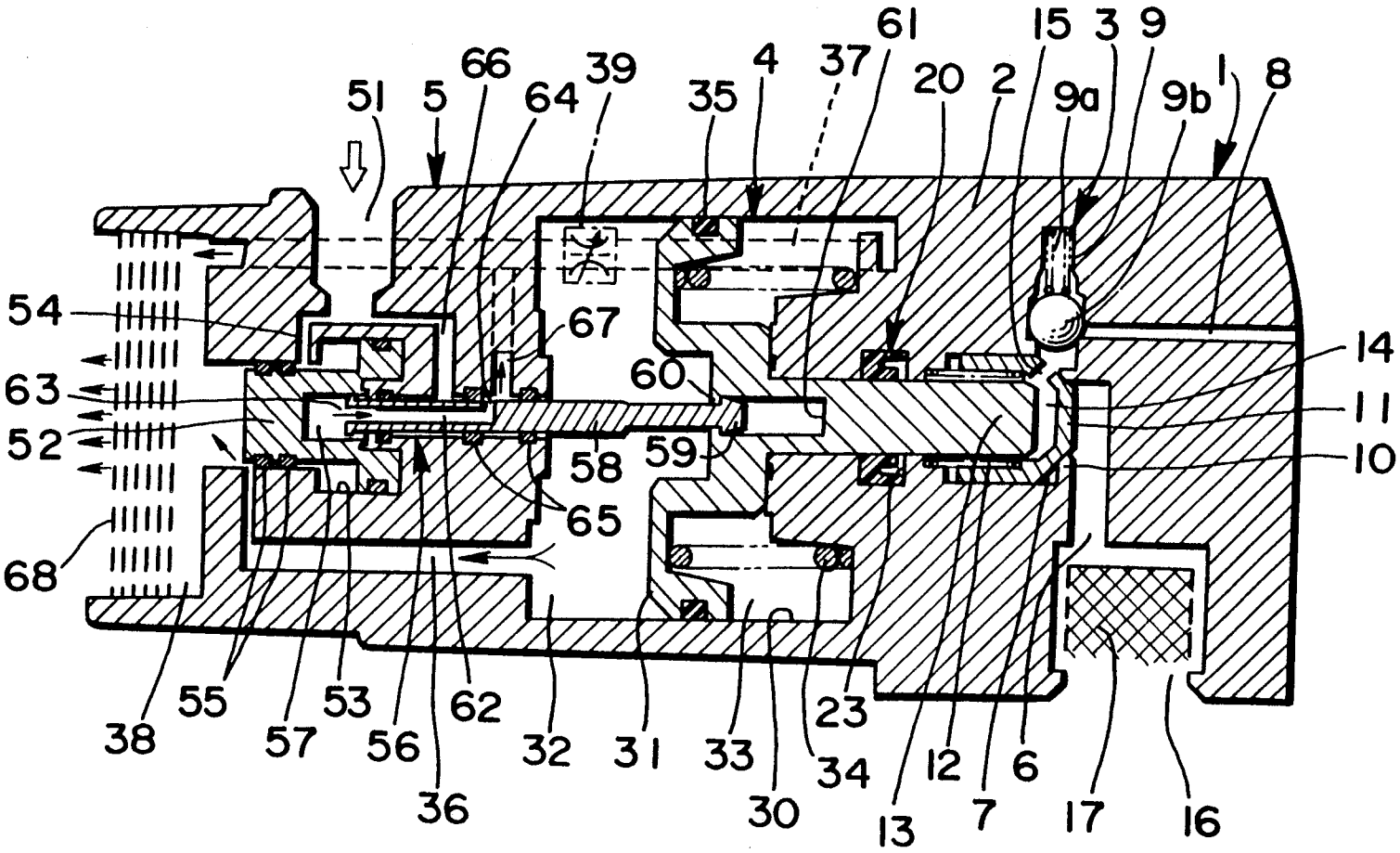
Figure 3:
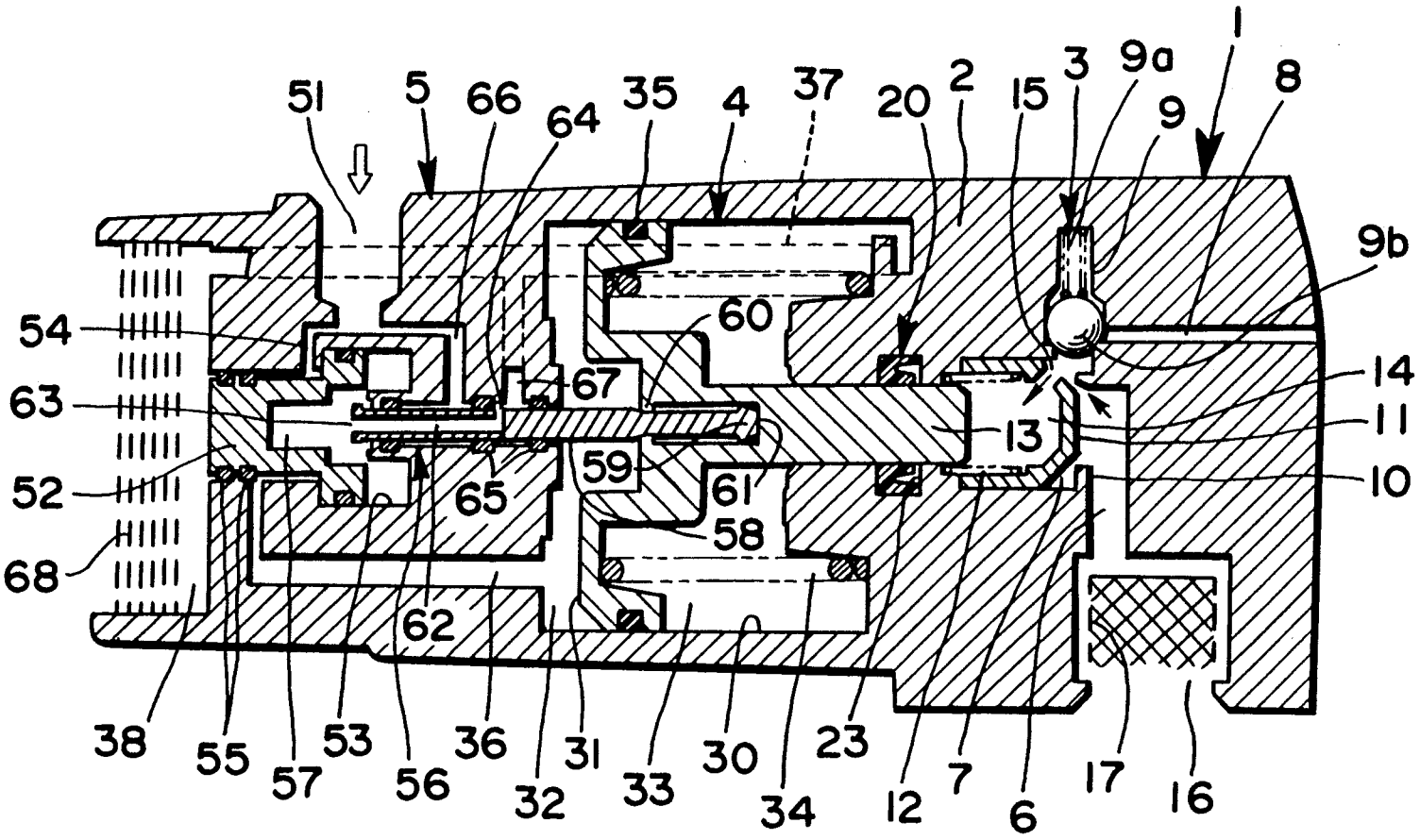

The reciprocating pump apparatus 1 as shown in FIG. 1 may be employed as a pump apparatus provided with an over load protecting means for a press for example. The reciprocating pump apparatus 1 includes a casing 2. In the casing 2, there are incorporated a pump portion 3, a driving piston portion 4 and a change-over control portion 5. Another construction is available in which the casing 2 is comprised of several casing components tied together in the different manner from the illustration.

The pump portion 3 comprises a suction passage 6 for fluid such as oil, a pump chamber 7 in communication with the suction passage 6, a delivery passage 8 opening to the pump chamber 7 and a delivery valve 8 provided in the delivery passage B. A delivery valve 9 may be formed as a check valve having a ball **9*b* biased by a spring 9*a* and the inlet of the delivery valve 9 may be connected directly to the pump chamber 7**.

At the border portion between the pump chamber 7 and the suction passage 6 is formed a valve seat 10 in which a suction vlave member 11 is seated. The suction valve member 11 is formed as a cup-shaped member having a cylindrical circumference adapted to be slidably guided in the pump chamber 7 of the casing 2 and a portion of the valve member which is seated on the valve seat 10 has a configuration conforming to a bottom of the cup. In an inner hollow portion of the suction valve member 11, there is slidably guided a plunger 13.

A hollow space is formed as a plunger chamber 14 between the suction valve member 11 and the plunger 13 and the plunger chamber 14 is in communication with the pump chamber 7 through a throttling port 15 formed at the suction valve member 11.

The throttling port 15 is so formed at the suction valve member that when the suction valve member 11 is seated on the valve seat 10, the throttling port 15 is opened directly to the delivery valve 9. The position of the throttling port 15 is selected to be near to that of the valve seat 10.

A spring 12 is provided between the suction valve member 11 and the casing 2 and the suction valve member 11 is urged to the valve seat 10 by the spring.

Reciprocation of the plunger 13 causes the fluid to be sucked from the suction passage 6 and delivered from the delivery passage 8 thus providing a pumping action.

When the pump apparatus 1 starts operation, the air in the suction conduit connected to the suction passage 6 is evacuated to generate vacuum to induce the fluid. A determined degree of vacuum is required to induce the fluid such as oil. It is necessary to provide vacuum as high as possible in the suction conduit in order to meet the requirement of sucking and delivering the fluid in such a suction conduit having a high level suction head. It is also necessary to keep the cracking pressure at the suction valve low enough. In view of this, it is preferable to employ a spring which is as weak as possible as the spring 12.

When a weak spring 12 is employed, if the plunger chamber 14 is filled with fluid by suction, the suction valve member 11 cannot be quickly seated on the valve seat 10 when the delivery stroke is commenced, so that a portion of the fluid may be returned to the suction passage 6, resulting in worse delivery efficiency. The size of the throttling port 15 is so selected for avoiding this problem that even if a weak spring 12 is employed, the suction valve member may be quickly closed or the suction valve member 11 may be quickly seated on the valve seat 10. By properly selecting the size of the throttling port, when the plunger 13 changes its stroke from suction stroke to the delivery stroke, slight pressure will be generated in the plunger chamber 14 and the pressing force against the suction valve member 11 towards the valve seat 10 is increased, thus facilitating closing motion of the suction valve member 11 to reduce the amount of the fluid which returns to the suction passage 6 and enhancing the delivery efficiency of the pump apparatus.

It is preferable in order to increase the vacuum at the time of start-up that the clearance volume between the plunger and the inlet of the delivery valve in which compressive air may remain at the delivery stroke of the plunger should be eliminated in addition to provision of said weak spring. In order to reduce the clearance volume, the throttling port 15 of the suction valve member 11 should be located at such a position when it will provide a direct communication between the plunger chamber 11 and the inlet of the delivery valve 9 at the end of the stroke of said plunger 13. By this arrangement, when the plunger 13 reverses its stroke from the delivery stroke to the suction stroke, the amount of the air which may remain between the plunger chamber 11 and the delivery valve 9 may be extremely reduced or the clearance volume (the volume of the clearance) may be made very small.

When the present pump apparatus commences operation, the dust or the foreign matters contained in the suction conduit may be sucked together with air and the plunger 13, the suction valve member 11, the valve seat 10 and the like may be damaged. In order to prevent such damage, a filter 17 is removably attached to the fluid suction inlet 16 which is the entrance to the suction passage 6.

By this filter, the foreign matters and the dust which will be otherwise sucked in will be caught by the filter 17 and prevented from entering in the suction passage 6, preventing said plunger 13 and the like from getting damaged.

A fluid sealing means 20 is attached to the casing 2 in order to prevent leakage of the fluid sucked in the plunger chamber 14 and the plunger 13 slides relative to the fluid sealing means 20.

Figure 4:
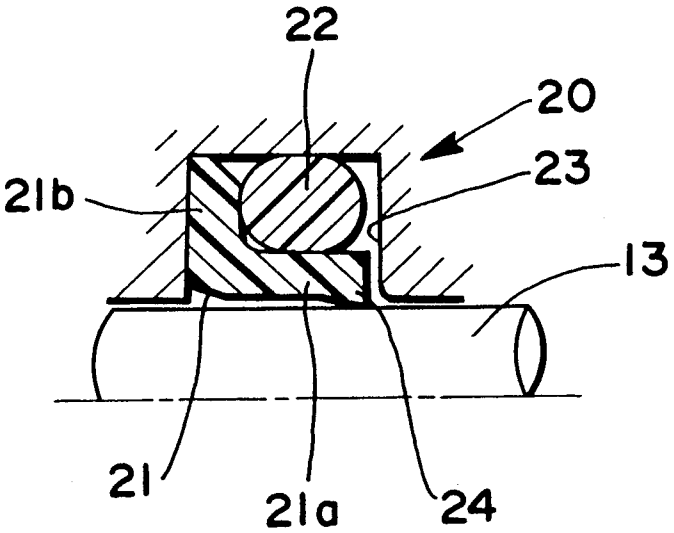

As shown in FIG. 4, the fluid sealing means 20 comprises an elastic ring 22 and a seal ring 21 having a function equivalent to a back-up ring adapted to prevent the elastic ring 22 from being squeezed out. The seal ring 21 is configured to "L" and made up of a low abrasion, low sliding resistance material. Said seal ring 21 includes the sliding portion 21*a* adapted to contact with the plunger 13 and the flange portion 21*b* adapted to support the elastic ring 22 and prevent said elastic ring from being distorted and broken. A lip portion 24 is formed at the sliding portion 21*a* and serves as scraper for the fluid film produced on the surface of the plunger 13. This lip 24 serves for preventing leakage of the fluid.

The elastic ring 22 may be formed of O-ring, a square ring or the like. The elastic ring 22 is accomodated in the groove 23 of the casing 2 and the plunger 13 is slidably inserted in a sliding portion 21*a* of the seal ring 21.

Figure 5:
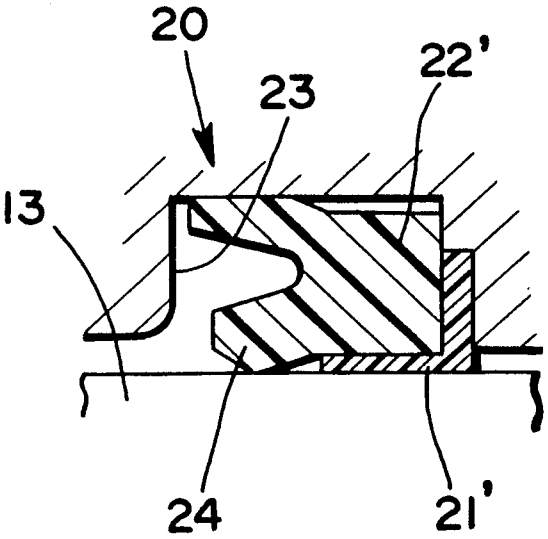
FIG. 4 and FIG. 5 are the sectional views of the different embodiments of the fluid sealing means.

Another embodiment of the fluid sealing means 20 is shown in FIG. 5 as having an elastic ring 22' made of a packing having "U" like configuration and the seal ring 21' having the section configuration of "L". A lip 24 is formed at the elastic ring 22', the lip being made of or covered by a low abrasion, low sliding resistance material. The lip is not formed on the seal ring 21'. The seal ring 21' is made of a low abrasion, low sliding resistance material, making the sliding resistance at the sealing surface small at the time of a high pressure being imposed.

As shown in FIG. 1, the driving piston part 4 adapted to drive the plunger 13 at the pump portion 3 includes a piston 31 which is slidably guided in a cylinder chamber 30 of the casing 2. The piston 31 may be integrally formed with the plunger 13 of said pump portion 3. The cylinder chamber 30 is divided by the piston 31 into a pressure chamber 32 and a spring chamber 33. In the spring chamber 33, there is provided a spring 34 under compression between the casing 2 and the piston 31. The spring 34 is adapted to press the piston 31 in the suction direction in the case of illustration in FIG. 1 which is not understood to be the limited embodiment. As it is well known, the piston 31 includes a sealing member 35 which serves as the seal between the pressure chamber 32 and the spring chamber 33. The flow passage 36 is in comunication with the pressure chamber 32 and the pressurized fluid such as compressed air contained in the pressure chamber 32 may be supplied or discharged through said passage 36.

Figure 6:
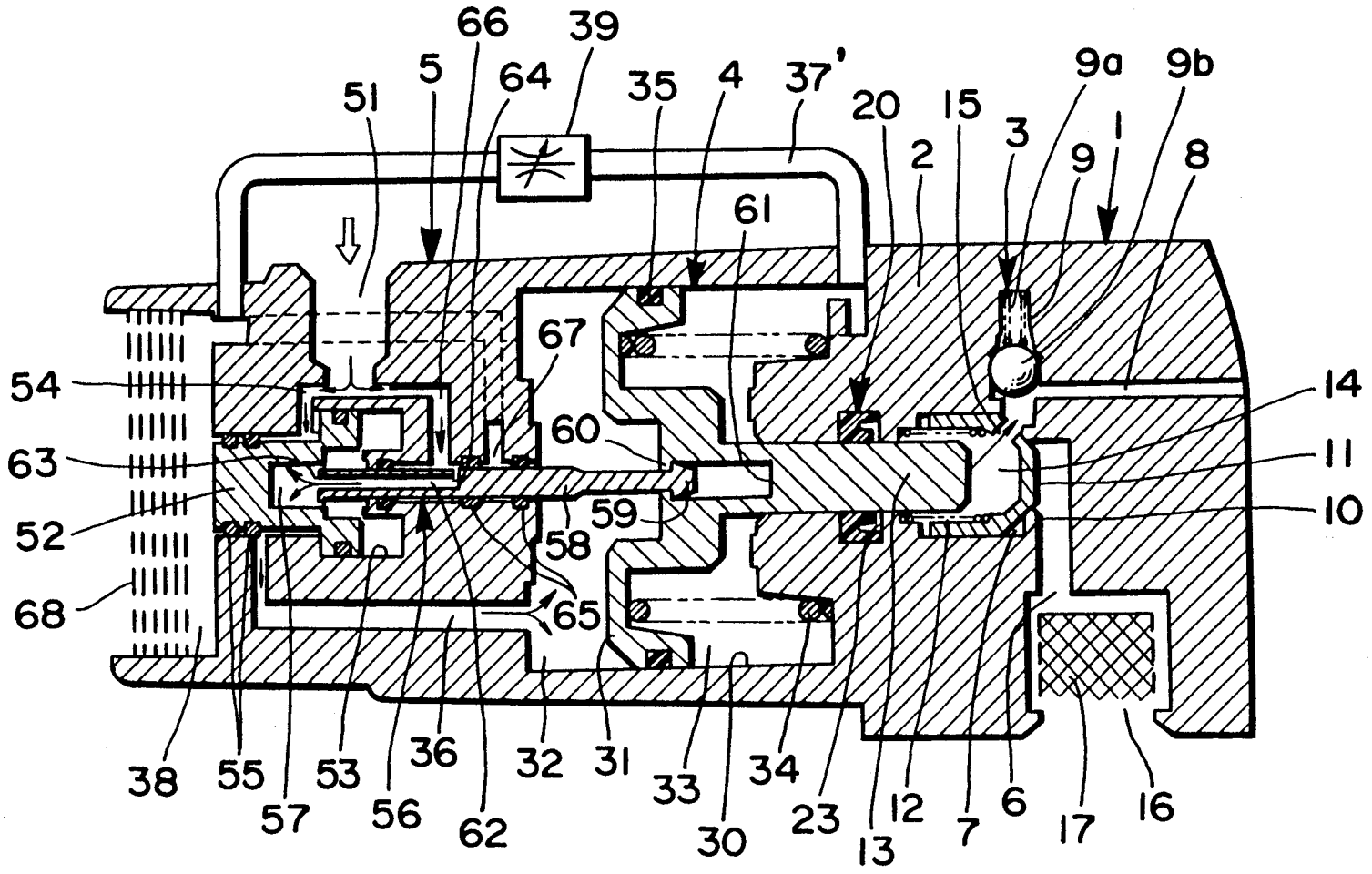
FIG. 6 is the sectional view of another embodiment of the reciprocating pump apparatus accoring to the present invention.

Reciprocation of the piston 31 will cause the plunger 13 to be reciprocated to suck or deliver the fluid in the pump part 3. If the fluid sucked in the pump part is compressive fluid like air or contains compressive fluid, then the load resistance of the plunger 13 will be smaller than in the case of incompressive fluid such as oil or the like and the piston 31 and the plunger 13 are caused to operate at a higher frequency than otherwise. This sort of situation will occur mainly at the time of start-up. In order to avoid this situation, a variable throttle is provided at the opening in the spring chamber 33 to the atmosphere so as to enable the back pressure to the piston 31 in the spring chamber 33 to be adjustable. As shown in FIG. 1, the spring chamber 33 is connected to the discharge port 38 through the communication passage 37 formed in the casing 2 and a variable throttle 39 may be provided at said communication passage 37. The communication passage 37 may make use of a bore for a bolt formed in the casing 2. Furthermore as shown in FIG. 6, the spring chamber 33 and the discharge port 38 may communicate with each other by means of the pipe line 37' provided externally of the casing 2 and a varialbe throttle 39 may be provided at the pipe line 37'. When the load resistance relative to the piston 31 is small because of sucking of the compressive fluid, then back pressure may be developed in the spring chamber 33 by throttling said variable throttle, so that the piston 31 may be reciprocated with the same load resistance as in the case of incompressive fluid being employed. When incompressive fluid is sucked or delivered, then the throttle 39 will be fully opened so that no back pressure may be developed in the spring chamber 33. This will permit the piston to be reciprocated always at the same frequency regardless of the properties of the fluid.

Reciprocation of the piston 31 may be changed over due to variation of the pressure in the pressure chamber 32 through switching supply and exhaust of the compressed air in the pressure chamber 32. In this regard, the change-over control part 5 adapted to change over the supply or discharge of fluid to the flow passage 36 to the pressure chamber 32 is provided as the means of switching the reciprocation of the piston 31.

The change-over control part 5 includes a selector valve 52 adapted to change a connection of the flow passage 36 communicating with the pressure chamber 32 to the supply port 51 or to the discharge port 38 each provided in the casing 2. The selector valve 52 is slidably guided in the change-over chamber 53 in the casing 2. When the selector valve 52 is located at the first position shown in FIG. 1, the supply passage 54 is connected to the supply port 51 and the flow passage 36 is in communication with the port 51 through the clearance around the circumference of the selector valve 52 and the flow passage 36 is isolated from the discharge port 38 through the seal member 55 provided on the selector valve 52. When the selector valve 52 is moved rightwardly in FIG. 1 to the second position, the flow passage 36 communicates with the discharge port 38 and the flow passage 36 is isolated from the supply passage 54 through the seal member 55.

A pilot valve means 56 is provided as the means of moving said selector valve 52.

The pilot valve means 56 is slidably guided in the casing 2 and one end of the pilot valve body 58 is so formed as to project into the pilot chamber 57 formed in the selector valve 52 and the other end is so formed as to project into the piston 31. The pilot valve body 58 includes an engagement portion 59 at the portion projecting into the piston 31. The engagement portion 59 is shown in FIG. 1 as engaged with the hook portion 60 formed on the piston 31 and the rightward movement of the piston 31 as viewed in the drawing causes the pilot valve body 58 to be pulled by the piston 31. Movement of the piston 31 in the opposite direction will cause the engagement portion 59 of the pilot valve body 58 to engage with nothing until said engagement portion 59 will abut against the surface 61 serving as the second engagement portion of the piston 31, so that movement of the piston 31 will not be transmitted to the pilot valve body 58 during the non-engagement. In other words, the pilot valve body 58 is stationary during this period of time.

A flow passage 62 is formed in the pilot valve body 58 as a hollow bore and a first opening 63 formed at one end of the hollow bore at a side of the pilot chamber 57 is in communication with the pilot chamber 57. The other end of said hollow bore is opened to the side surface of the pilot valve body 58 as the second opening 64.

A pilot supply passage 66 in communication with said supply port 51 and a pilot discharge passage 67 in communication with the discharge port 38 are respectively formed in the casing 2.

When the pilot valve body 58 is located at the leftmost position as shown in FIG. 1, the second opening 64 of the flow passage 62 is in communication with the pilot supply passage 66 and at this time the pilot supply passage 66 and the second opening 64, and the pilot discharge passage 67 are isolated from each other by the valve seal 65 fitted in the casing 2.

When the piston 31 is moved rightwardly from the position shown in FIG. 1, the pilot valve body 58 is pulled rightwardly with the engagement portion 59 being engaged with the engagement hook portion 60, so that the second opening 64 is switched from the position where it is in communication with the pilot supply passage 66 to the position where it is in communication with the pilot discharge passage 67.

When the pilot valve body 58 is located at the first position where the second opening 64 is in communication with the pilot supply passage 66, the compressed air is supplied in the pressure chamber 32 causing the piston 31 to move forwardly. When the pilot valve body 58 is located at the second position where the second opening 64 is in communication with the pilot discharge passage 67, the compressed air in the pressure chamber 32 is exhausted, causing the piston 31 to return backwardly under the influence of the spring 34.

When the forward or backward movement of the piston 31 comes near the end of the stroke, the engagement portion 59 of the pilot valve body 58 will engage with the engagement hook portion 60 or the abutment surface 31 of the piston 31 to cause the pilot valve body 58 to travel together with the piston 31 to place or change over the pilot valve means 56 at the supply position or the discharge position.

Having changed over the pilot valve means 56, the pressure working against the selector valve 52 will be changed and the selector valve 52 will be changed over to cause the compressed air in the pressure chamber 32 to be supplied or discharged. With the pressure chamber 32 changed over between supply and discharge of the fluid, the pressure working against the piston 31 will also be varied and the movement of the piston 31 will be reversed.

When the thrust force by the compressed air working against piston 31 is balanced with the thrust force at the load side, then the piston 31 is caused to stop and the piston will resume reciprocation when said balanced condition will become out of order. When the balanced condition is being nearly reached so that the piston 31 is moved at an extremely low speed and the reversal position is also being reached, then the pilot valve body 58 is caused to move together with the piston 31, so that the pilot valve means 56 will be changed over. Change-over of the pilot valve means 56 causes the selector valve 52 to be changed over and even if the piston 31 is reversed due to change of the pressure in the pressure chamber 32, movement of the piston 31 will not be immediately transmitted to the pilot valve body due to the engagement between the piston 31 and the pilot valve body 58 being released. Accordingly the pilot valve body 58 is held at the current position. It is after the piston 31 has travelled a predetermined distance that the pilot valve body 58 will engage with the piston 31 and commence movement. While the pilot valve body 58 has been stopped, the pressure air can be sufficiently supplied to or discharged from the pilot valve means 56, ensuring that the selector valve 52 can be moved to the changed-over position. Possibility of the selector valve 52 being stopped at an intermediate position could be avoided.

Since a play in respect of transmission of the movement of the piston to the pilot valve body has been provided according to the present invention wherein the piston and the pilot valve body are not firmly connected and at the reversal movement of the piston no movement of the piston will be transmitted to the pilot valve body, the reversal movement of the piston will not be transmitted immediately to the pilot valve body, the pilot valve body is held at the current position for the time required for completely changing over the selector valve and the pilot valve body is prevented from change-over movement while the selector valve is being changed over. Accordingly the present invention has made it possible to avoid movement of the piston at an extremely slow speed due to stoppage of the change-over valve on a halfway if the thrust forces are balanced.

According to the present invention, at the time of reversal operation of the piston which has been operating at an extremely slow speed due to an extremely slight delivery of the liquid, the pilot valve means working against the selector valve for change-over operation may maintain pressure supply condition for a necessary period of time without changing from the pressure supply condition to the closed condition abruptly, whereby the selector valve could operate quickly and thus the piston could also operate quickly. More specifically when the thrust forces are balanced, the piston can be positively stopped and held at the relevant position. When said position is located at the reversal position from the forward movement to the backward movement, the piston will be quickly returned to the position commencing the forward movement and stopped and held at the position.

Furthermore according to the present invention, supply to and discharge from the spring chamber of the compressive fluid may be adjustable by means of the throttle means and also the back pressure in the spring chamber may be adjusted. Therefore at the time of start-up of operation, the throttle means is so throttled as to develop back pressure in the spring chamber to compensate for reduction of the load resistance by the compressive fluid in the pipe line, the throttle means is opened when incompressive fluid only is applied to remove back pressure in the spring chamber to keep the load resitance against the piston constant. Though this arrangment, idle hammering effect has been avoided and the adverse effect for the durability of components has been eliminated.

Further according to the present invention, the cracking resistance at the suction valve has been made small by employing a weak spring and a fine pressure has been developed in the course of delivery stroke in the plunger chamber by the resistance of the fluid flowing from the plunger chamber to the delivery passage through a throttle port provided specially at the suction valve member for this purpose and the fine pressure in the plunger chamber is added to the force of the spring as the force pressing the suction valve member against the valve seat enabling the suction valve member to be rapidly closed, whereby the flow rate of the fluid returning in the suction passage could be reduced and the delivery efficiency could be enhanced.

Further according to the present invention, an inlet to the delivery valve has been provided at the location near to the plunger chamber at the end of delivery stroke of the piston so as to reduce useless clearance volume. Through this arrangement, considerable vacuum could be developed in the suction pipe line at the start-up of the pump apparatus and the pressure resistance by the fluid which caused reduction of operation frequency of the plunger could be eliminated and reduction of devlivery volume could be avoided.

Since a filter has been provided at the inlet to the suction passage of the pump apparatus according to the present invention, damage to the pump components by the foreign matters in the pipe line could be prevented.

Furthermore according to the present invention, by providing fluid seal means comprising an elastic ring and a seal ring made of a low abrasion, low sliding resistance material and having the sectional confriguration of "L" and also by forming a lip portion in contact with the plunger at one of said elastic ring and seal ring, the fluid film developed on the plunger could be scraped off even at a high pressure and the amount of the film drawn out could be reduced so small that such troublesome drain port, drain pipe lines and the like as seen in the prior art could be eliminated. The seal ring according to the present invention has reduced the sliding resistance so considerably that the piston could be operated rapidly and the delivery flow rate of the pump has been increased as well as the delivery pressure could be made stable. The seal ring according to the present invention has the function equivalent to that of the back-up ring in respect of preventing the elastic ring from being squeezed out. Formation of a lip portion could further minimize the sliding resistance and also enhanced capability of scraping off the fluid film. Since the sliding resistance of the seal ring could be reduced small, distortion of the fluid sealing member due to sliding abrasion resistance could be prevented at both high pressure and low pressure.

Furthermore, the serviceable life of the seal ring and the elastic ring has been increased according to the present invention.

What is claimed:

1. A reciprocating pump apparatus adapted to reciprocate a piston between forward and backward ends of a stroke by alternately switching a supply and discharge of a pressurized fluid working against said piston by means of a selector valve, wherein said switching operation of said selector valve is controlled by switching pilot supply and pilot discharge flow passages by a pilot valve body which is switched by said piston at said ends of the stroke of said piston between forward movement and backward movement, and the fluid is sucked through a suction valve and discharged through a delivery valve by a plunger reciprocated by said piston, the improvement wherein said pilot valve body has first and second means for engaging said piston for predetermined distances to and from the ends of the respective forward and backward strokes of said piston, for moving said pilot valve between a first position connecting said supply to said selector valve via said pilot supply passage to apply working pressure to said selector valve and a second position connecting said selector valve to said discharge via said pilot discharge passage to remove working pressure from said selector valve in said second position, said means for engaging comprising means for releasing said pilot valve from engagement with said piston and holding it at said each of said switching positions for a predetermined distance of movement of said piston, said pump apparatus further including a pump chamber connected respectively to a fluid suction passage and a fluid delivery passage, the suction valve body being adapted to move in said pump chamber and come in contact with or spaced from a valve seat to open and close the connection between the fluid suction passage and the pump chamber, and a check valve serving as a delivery valve adapted to open and close the connection between said pump chamber and the fluid delivery passage, said suction valve body comprising a cup-shaped member adapted to reciprocally guide said plunger, the plunger chamber defined between said suction valve body and the plunger and the throttling port in communication with the inlet of said delivery valve being formed in said suction valve body, and wherein a spring is provided to urge said suction valve body against the valve seat and is selected to be a weak spring necessary for reducing the cracking pressure of the suction valve to a desired level.

2. A reciprocating pump apparatus as claimed in claim 1 wherein an inlet of said delivery valve is opened to said pump chamber at a position adjacent to said plunger chamber at completion of the delivery stroke of said plunger.

3. A reciprocating pump apparatus as claimed in claim 1 wherein a filter is provided at the inlet of said suction chamber.

* * * * *